United States Patent [19]

Miller

[11] Patent Number: 4,729,291

[45] Date of Patent: Mar. 8, 1988

[54] GAS COMPRESSOR

[75] Inventor: Bernard F. Miller, Corning, N.Y.

[73] Assignee: Ingersoll-Rand Company, Woodcliff Lake, N.J.

[21] Appl. No.: 886,647

[22] Filed: Jul. 18, 1986

[51] Int. Cl.[4] ..... F01B 9/00

[52] U.S. Cl. ..... 92/138; 92/150; 92/152; 92/175; 92/258

[58] Field of Search ..... 92/138, 146, 147, 150, 92/151, 152, 175, 157, 165 PR, 258, 257

[56] References Cited

U.S. PATENT DOCUMENTS

| | | | |
|---|---|---|---|
| 762,646 | 6/1904 | Morison | 92/138 X |
| 1,429,829 | 9/1922 | Baker | 92/152 X |
| 1,865,000 | 6/1932 | Goldberg | 92/152 X |
| 4,095,922 | 6/1978 | Farr | 417/313 |
| 4,302,160 | 11/1981 | Hofmann, Jr. | 417/313 |
| 4,486,157 | 12/1984 | Hayashi | 92/138 X |

FOREIGN PATENT DOCUMENTS

| | | | |
|---|---|---|---|
| 318464 | of 0000 | France | 92/138 |
| 649322 | 12/1928 | France | 92/138 |
| 24679 | 2/1977 | Japan | 92/151 |

*Primary Examiner*—Robert E. Garrett
*Assistant Examiner*—Mark A. Williamson
*Attorney, Agent, or Firm*—B. J. Murphy

[57] ABSTRACT

The Compressor is small, compact and lightweight in that it is formed of the barest essentials. It has a pair of in-line cylinders, with pistons reciprocatable therein, and the crankshaft, having only one crank, is drivingly coupled to one of the pistons. The other piston is fastened to the crank-driven piston, in spaced-apart disposition, for a common reciprocation of the two. One of the cylinders serves as the crankcase.

4 Claims, 2 Drawing Figures

GAS COMPRESSOR

This invention pertains to gas compressors, and in particular to small, compact and lightweight compressors formed of only the base essentials.

There exist certain applications for small, compact and lightweight gas compressors of single and/or two-stage functioning, with various outlet gas pressures. Such compressors should not measure more than six inches, by twelve inches, by eight inches, they should have a small flow output, and preferably, they ought to weigh under twenty pounds.

It is an object of this invention to set forth a very simplified gas compressor which, accordingly, meets the aforesaid criteria for such a small, compact and lightweight package.

It is particularly an object of this invention to disclose a gas compressor, comprising a pair of opposed, in-line cylinders; a pair of opposed, in-line pistons disposed in said cylinder for reciprocation; a crankshaft having a single crank formed therealong; a connecting rod interconnecting said crank and one of said pistons; and means fastening said pistons together, in spaced-apart disposition, for common reciprocation.

It is a further object of this invention to teach a gas compressor comprising a plurality of cylinders; a same plurality of pistons disposed in said cylinders for reciprocation; and means for reciprocating all pistons of said plurality thereof; wherein said means comprises a crankshaft having at least one crank; each crank of said crankshaft has one end of a connecting rod coupled thereto; the opposite end of said rod being coupled to one of said pistons; and each such rod-coupled piston is fastened to another piston of said plurality, in spaced apart disposition, for coincident reciprocation therewith.

Figure 1:
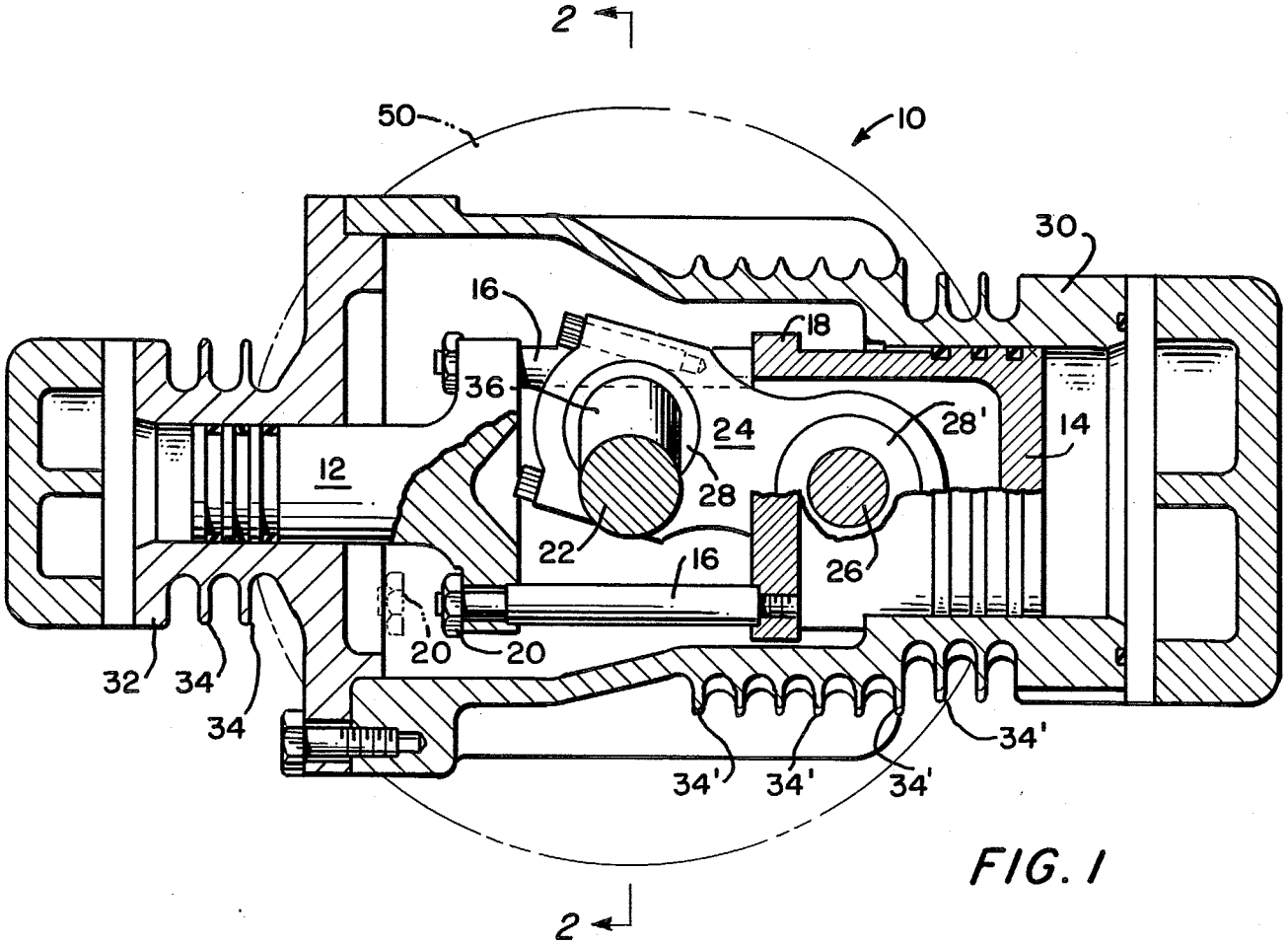
Figure 2:
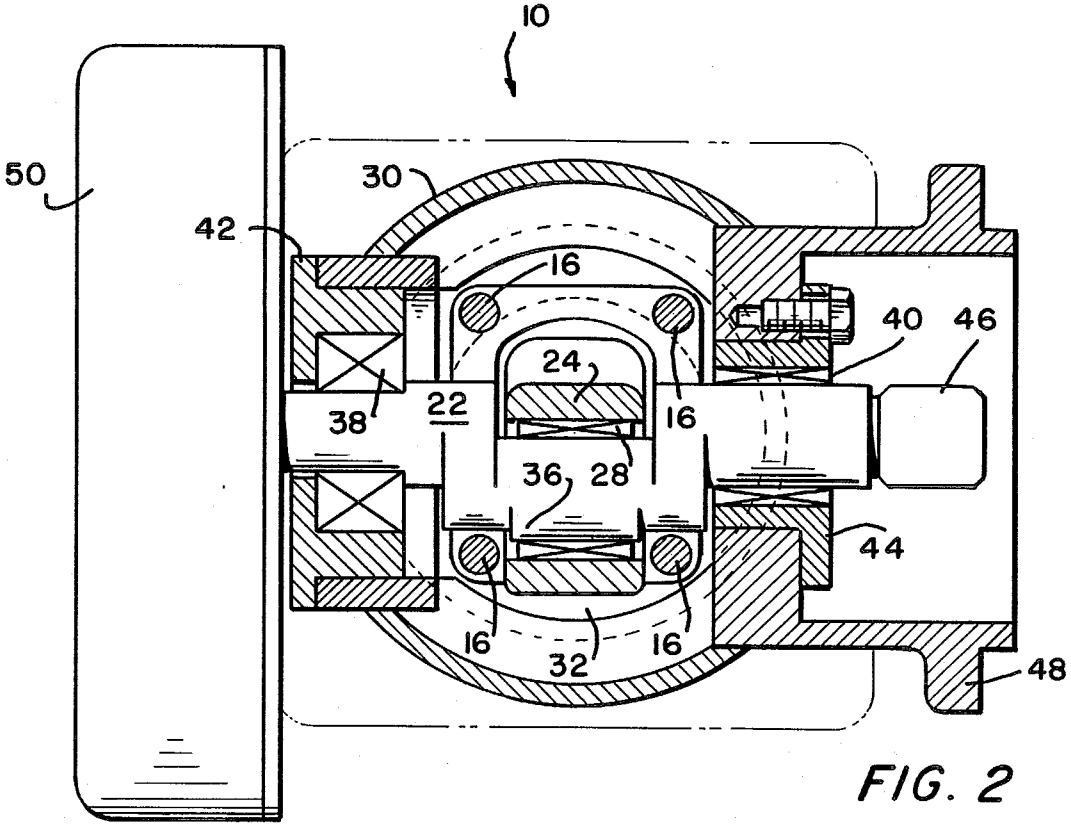

Further objects of this invention, as well as the novel features thereof, will become more apparent by reference to the following description taken in conjunction with the accompanying figures, in which:

FIG. 1 is cross-sectional illustration of an embodiment of the invention taken generally lengthwise thereof; and FIG. 2 is a cross-sectional view taken along section 2—2 of FIG. 1.

As shown in the figures, the novel compressor 10 uses a centerline guide formed by two pistons 12 and 14 which are connected by four, identical rods 16. The rods 16 are threadedly fastened in the skirt 18 of piston 14, and bolted to piston 12 with nuts 20. To translate the rotating motion of a crankshaft 22 to a reciprocating motion of the pistons 12 and 14, a connecting rod 24 is pinned to the larger piston 14 with a hardened steel pin 26. Separate sleeve bearings 28 and 28' are used with the connecting rod 24. This aforesaid arrangement accommodates a very short coupling, and the rods 16 reduce weight considerably, but maintain strength and stiffness of the assembly. There is no separate crankcase; the larger barrel-like cylinder 30 is extended to serve as the crankcase. The smaller cylinder 32 is bolted directly to the larger cylinder 30. Convolutes 34 and 34' are formed on the cylinders 30 and 32 to dissipate heat. The crankshaft 22 which has only the one crank 36, is carried in bearings 38 and 40 which are mounted in sleeves 42 and 44. These sleeves are bolted in place (only one bolt being shown) for ease of assembly. The driver end 46 of the crankshaft 22 can be of any type of coupling and the flange 48 can be directly attached to the driver or prime mover. Counterweighting (not shown) can be provided at each end of the crankshaft 22 for better balance if required for smoother operation. The compressor is air cooled by a fan 50 drivenly attached to the crankshaft 22. Lubrication is by splashed oil but can be by oil pump pressure lubrication, or the compressor can be adapted for non-lubricated construction. This embodiment of the compressor is designed to operate to speeds up to 4000 RPM. While I have described my invention in connection with a specific embodiment thereof, it is to be clearly understood that this is done only by way of example and not as a limitation to the scope of my invention, as set forth in the objects thereof and in the appended claims.

I claim:

1. A gas compressor, comprising:

a pair of opposed, in-line cylinders opening onto each other in an unobstructed confronting relationship;

a pair of opposed, in-line pistons disposed in said cylinders for reciprocation;

a crankshaft having a single crank formed therealong;

a connecting rod directly interconnecting said crank and one of said pistons; and means fastening said pistons together into a unitized assembly, albeit with said pistons in spaced-apart disposition, for reciprocation of said assembly; wherein said fastening means comprises four, identical rods;

each of said pistons has a head and a base, and at said base thereof, a radially extending flange or skirt;

said rods are in penetration of, and fastened to, said piston flanges or skirts to define, between said pistons, an open framework of said rods;

said crank is centralized within said framework;

said crankshaft traverses said framework; and said rods comprise means for strengthening and stiffening said assembly.

2. A gas compressor, according to claim 1, wherein: one of said cylinders comprises a crankcase.

3. A gas compressor, according to claim 1, wherein:

one of said cylinders is of a greater inside diameter than the other thereof; and said one cylinder comprises a crankcase.

4. A gas compressor, according to claim 1, further including:

a fan drivenly coupled to said crankshaft for cooling said compressor.

* * * * *